US012376641B1

(12) United States Patent
Zhou

(10) Patent No.: US 12,376,641 B1
(45) Date of Patent: Aug. 5, 2025

(54) SPORTS SHOE FOR FLAT FOOT PREVENTION AND CORRECTION

(71) Applicant: Jayjay CJZ Zhou, West Vancouver (CA)

(72) Inventor: Jayjay CJZ Zhou, West Vancouver (CA)

( * ) Notice: Subject to any disclaimer, the term of this patent is extended or adjusted under 35 U.S.C. 154(b) by 0 days.

(21) Appl. No.: 18/797,551

(22) Filed: Aug. 8, 2024

(30) Foreign Application Priority Data

Jun. 11, 2024 (CN) ..... 202421321254.9

(51) Int. Cl.

| | |
|---|---|
| ***A43B 13/20*** | (2006.01) |
| ***A43B 5/00*** | (2022.01) |
| ***A43B 7/14*** | (2022.01) |
| ***A43B 7/1464*** | (2022.01) |
| ***A43B 17/02*** | (2006.01) |
| ***A43B 17/03*** | (2006.01) |

(52) U.S. Cl.
CPC ..... *A43B 7/14* (2013.01); *A43B 5/00* (2013.01); *A43B 7/1464* (2022.01); *A43B 13/20* (2013.01); *A43B 17/02* (2013.01); *A43B 17/035* (2013.01)

(58) Field of Classification Search
CPC ..... A43B 7/142; A43B 7/1464; A43B 17/03; A43B 17/035; A43B 13/20
USPC ..... 36/29
See application file for complete search history.

(56) References Cited

U.S. PATENT DOCUMENTS

| | | | | | |
|---|---|---|---|---|---|
| 747,994 | A * | 12/1903 | Mayer et al. | A43B 7/142 | 36/3 A |
| 985,666 | A * | 2/1911 | Durieu | A43B 7/142 | 36/165 |
| 1,064,902 | A * | 6/1913 | Hall | A43B 17/03 | 623/56 |
| 1,223,368 | A * | 4/1917 | Carling | A43B 17/03 | 36/153 |
| 1,254,654 | A * | 1/1918 | Carling | A43B 17/03 | 36/153 |
| 1,544,547 | A * | 7/1925 | Barker | A43B 13/20 | 36/182 |
| 1,605,985 | A * | 11/1926 | Rasmussen | A43B 13/20 | 36/153 |
| 1,976,656 | A * | 10/1934 | Clark | A43B 13/20 | 36/153 |
| 2,177,116 | A * | 10/1939 | Persichino | A43B 17/03 | 36/153 |
| 2,365,807 | A * | 12/1944 | Dialynas | A43B 13/20 | 36/153 |
| 2,600,957 | A * | 6/1952 | Bartis | A43B 13/20 | 36/153 |

(Continued)

*Primary Examiner* — Marie D Bays

(57) ABSTRACT

A sports shoe for flat foot prevention and correction, including a sole, an upper and an insole, an area of the insole corresponding to the arch of human foot is D-shaped area for auxiliary correction training, the arc part of the D-shaped area are divided into three sections, namely a middle section connected to other parts of the insole as a whole and two opening sections which are between two ends of the middle section and two ends of the vertical line part of D shape, and the opening sections are separated from the other parts of the insole to form openings, the bottom surface of said D-shaped area is fixedly bonded with an airbag, the upper is fixedly equipped with a press type inflation and deflation valve, the air outlet of the inflation and deflation valve connects to the air inlet/outlet of the airbag through an inflation tube.

5 Claims, 4 Drawing Sheets

(56) References Cited

U.S. PATENT DOCUMENTS

| | | | | |
|---|---|---|---|---|
| 5,313,717 | A * | 5/1994 | Allen | A43B 13/20 36/35 B |
| 2001/0054242 | A1* | 12/2001 | Miller, II | A43B 5/001 36/144 |
| 2008/0040948 | A1* | 2/2008 | Park | A43B 7/142 36/43 |
| 2020/0375303 | A1* | 12/2020 | Lasso | A43B 13/203 |

* cited by examiner

SPORTS SHOE FOR FLAT FOOT PREVENTION AND CORRECTION

TECHNICAL FIELD

The utility model relates to the field of sports shoes structure, in particular to the field of sports shoes structure with foot correction function.

BACKGROUND OF THE INVENTION

Flat foot is a sick condition where the inner longitudinal arch of the foot is low or absent. Not only does it affect the ability to move and walking gait, but it can also affect the movement of bones and joints, causing damage. Therefore, many parents nowadays pay close attention to prevention and correction of their children's flat foot problems.

At present, most children and adolescents' shoes on the market do not have flat foot prevention and correction functions. A few specialized corrective shoes require specialized customization. However, due to children's rapid foot growth, specialized corrective shoes need to be discarded and replaced with new specialized customized ones after a short period of time, and it requires long-term persistence. Thus most people who need flat foot prevention and correction often do not persist to it for a long time, which results in sub-optimal prevention and correction. Additionally, flat foot prevention training usually can't be started easily and quickly anytime and anywhere, so most children can't consciously achieve long time training, which also leads to poor prevention and correction. In view of this, the inventors of this utility model conducted research and improvement on existing shoes to solve the above problems, leading to the creation of this utility model.

BRIEF SUMMARY OF THE INVENTION

The purpose of this utility model is to provide a sports shoe for flat foot prevention and correction with an auxiliary training structure for flat foot correction training. It can be adjusted and changed at any time according to the needs of flat foot prevention and correction for auxiliary flat foot correction training.

To achieve the above objectives, the technical solution of this utility model is: A sports shoe for flat foot prevention and correction, comprising a sole, an upper bonded to said sole and an insole embedded in said upper and placed on said sole, the area of said insole corresponding to the arch of human foot is D-shaped area for auxiliary correction training, the vertical line part of D shape of said D-shaped area is the outline edge of the insole, while the arc part of D shape of said D-shaped area are divided into three sections, namely the middle section which is connected to the other parts of the insole as a whole and the two opening sections which are between the two ends of the middle section and the two ends of the vertical line part of D shape, and said opening sections are separated from the other parts of the insole to form openings, the bottom surface of said D-shaped area is fixedly bonded with an airbag, said upper is fixedly equipped with a press type inflation and deflation valve, the air outlet of said inflation and deflation valve connects to the air inlet/outlet of the airbag through an inflation tube.

A sinking groove is equipped on the bottom surface of said D-shaped area where one side of the airbag can be correspondingly embedded and fixedly bonded, said inflation and deflation valve is positioned on the outer surface of the upper corresponding to the inner side of human foot, said upper near the corresponding airbag is provided with a through hole for the inflation tube to pass through, said upper is fixedly equipped with a protection cover enveloping the inflation tube.

The upper surface of said insole is setup with a surface layer by compounding, said surface layer can have corresponding openings in the parts corresponding to the opening sections, or said surface layer can have elastic sections which are elastic and stretchable in the parts corresponding to the opening sections.

The upper surface of said insole is setup with a surface layer by compounding, said surface layer can have corresponding openings in the parts corresponding to the opening sections, or said surface layer can have elastic sections which are elastic and stretchable in the parts corresponding to the opening sections.

Said the sole forms a beveled surface at the boundary between its outer sidewall corresponding to the outside of human foot and the bottom surface of the sole.

The angle between said beveled surface and the horizontal plane is within 30-50 degree.

By adopting the above technical solution, the beneficial effect of the present utility model is that the sports shoe with above-mentioned structure arranges structure design in the D-shaped area of the insole, which allows the D-shaped area to have a larger space for movement and deformation compared to other parts of the insole. By installing airbag on the sole, when the airbag is inflated, the D-shaped area is lifted to form a bulge in the position of the insole corresponding to the arch position of human foot that supports the arch of foot. The bulge is conducive to shaping and supporting the arch curvature of the foot during toe retraction (toe grip) training for people with flat feet, which is beneficial for improving training effectiveness, thus forming an auxiliary training structure for flat foot correction training. The above-mentioned airbag uses a press type inflation and deflation valve, allowing for inflation and deflation at any time, with simple operation. Inflation of airbag can provide an ideal supportive fullness, thereby achieving the above-mentioned goal to auxiliary flat foot correction training by adjusting and changing at any time according to the needs of flat foot prevention and correction. Post-training deflation is quick and does not affect the comfortable use of the sports shoes for normal walking activities. In addition, the above structure has a simple structure, easy to manufacture, suitable for widespread application, stable and durable in structure, and can also be adapted for various types of shoe applications.

Figure 1:
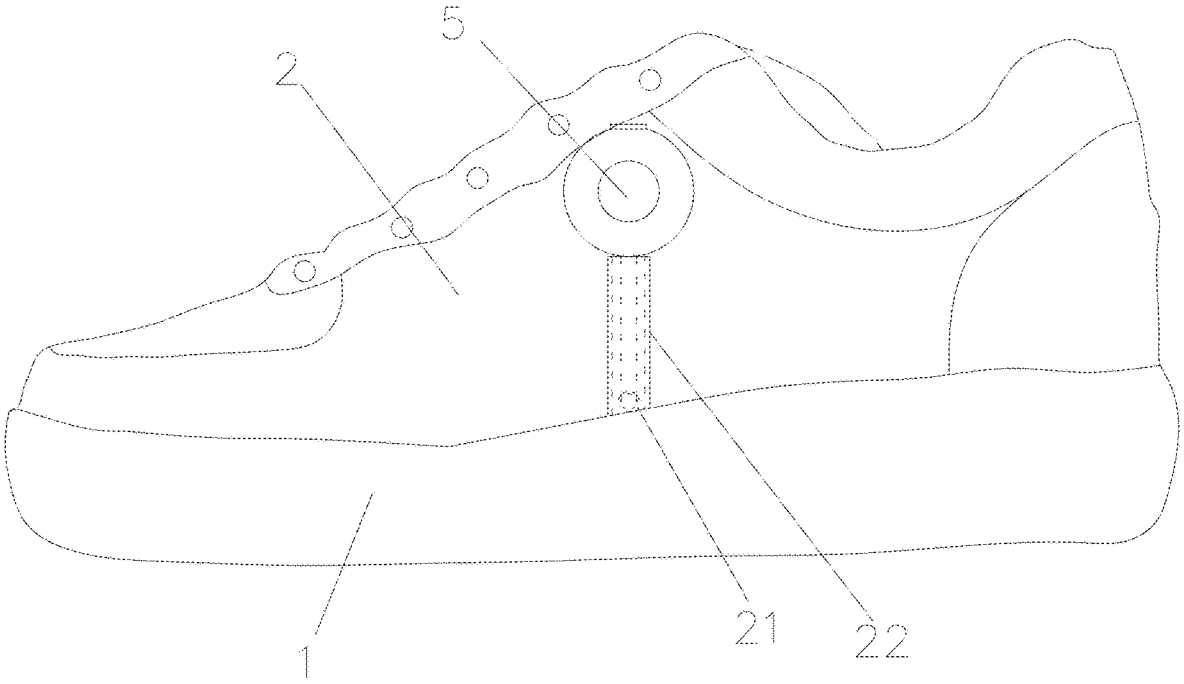
FIG. 1 is schematic diagram of the setting structure of the inflation and deflation valve in a sports shoe for flat foot prevention and correction related to the present utility model.

sole 1; beveled surface 11; upper 2; through hole 21; protection cover 22; insole 3;

shaped area 31; middle section 311; opening section 312; sinking groove 313; surface layer 314; elastic section 315;

airbag 4; inflation and deflation valve 5; inflation tube 6.

DETAILED DESCRIPTION OF THE INVENTION

To further explain the technical solution of the utility model, the following will provide detailed explanation of the utility model through specific embodiments.

Figure 2:
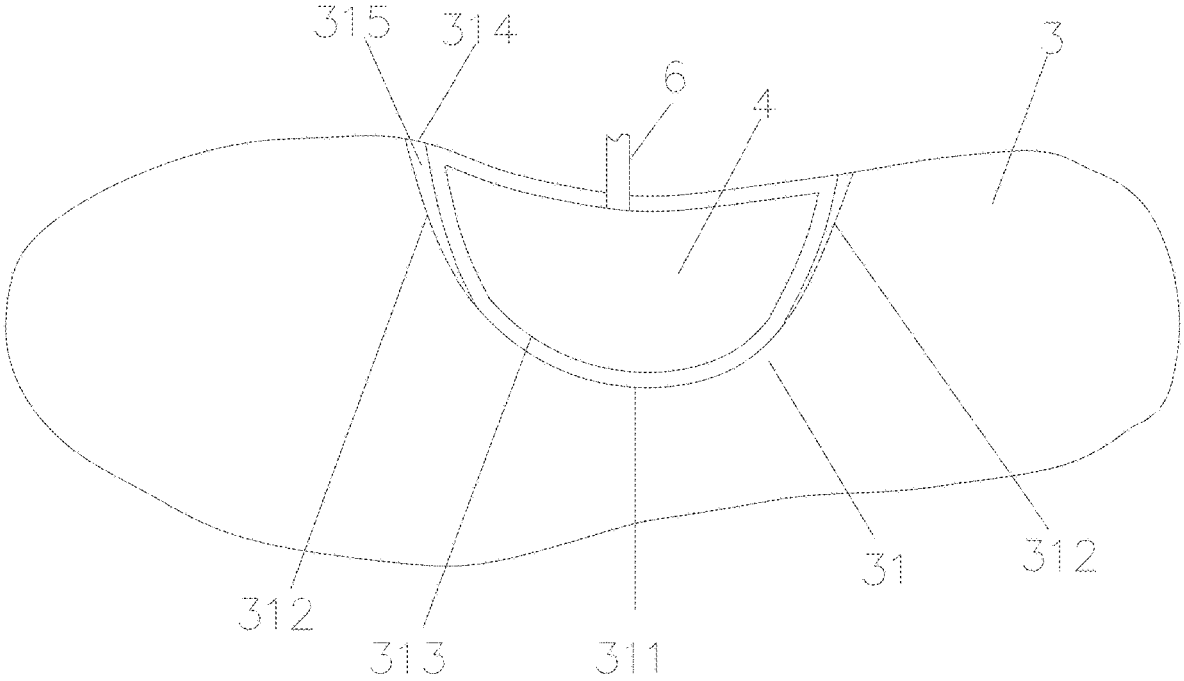
FIG. 2 is schematic diagram of the structure of the bottom surface of the insole in a sports shoe for flat foot prevention and correction related to the present utility model.
Figure 3:
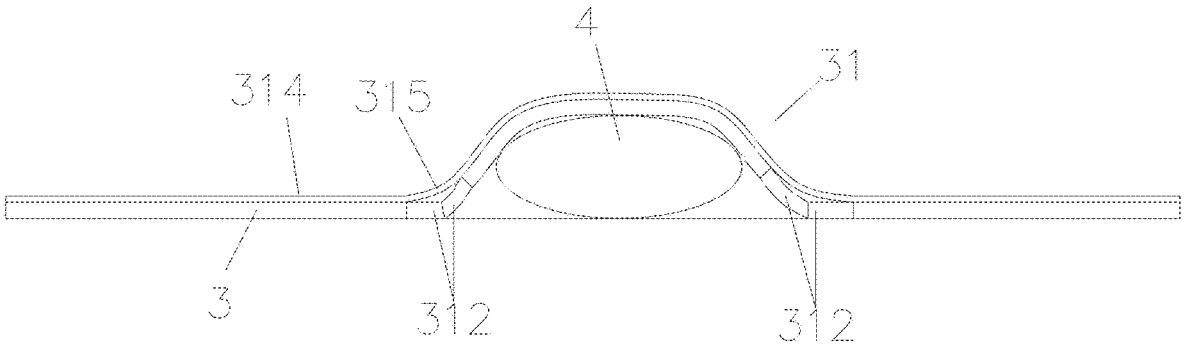
FIG. 3 is schematic diagram of the structure of the insole with airbag in inflated state in a sports shoe for flat foot prevention and correction related to the present utility model.

The present utility model discloses a sports shoe for flat foot prevention and correction, as shown in FIGS. 1, 2 and 3, comprising a sole 1, an upper 2 bonded to the sole 1 and an insole 3 embedded in the upper 2 and placed on the sole 3. The differences from existing shoe products are as follows: the area of the insole 3 corresponding to the arch of human foot is D-shaped area 31 for auxiliary correction training, the range of the shaped area can be set according to normal foot arch area of corresponding shoe size. The vertical line part of D shape of the D-shaped area 31 is the outline edge of the insole, while the arc part of D shape of the D-shaped area 31 are divided into three sections, namely the middle section 311 which is connected to the other parts of the insole 3 as a whole and the two opening sections 312 which are between the two ends of the middle section 311 and the two ends of the vertical line part of D shape, and the opening sections 312 are separated from the other parts of the insole 3 to form openings, as shown in figures, so that the D-shaped area 31 can move relative to the other parts and has a large deformation space to implement auxiliary training structure. The bottom surface of the D-shaped area 31 is fixedly bonded with an airbag 4, which is placed on the bottom surface of the D-shaped area 31 to protect it well and make it less prone to damage and detachment. When the airbag 4 is in inflated state, it lifts the D-shaped area 31 as shown in FIG. 3, when deflated, it remains flat without any other impact. To further prevent the problem that the installation of the airbag 4 may cause the human foot to feel abnormal when wearing shoes, a sinking groove 313 is equipped on the bottom surface of the D-shaped area 31 where one side of the airbag 4 can be correspondingly embedded and fixedly bonded. So that when the airbag 4 is not inflated and remains flat, it can be embedded in the sinking groove 313, which makes the insole naturally flat.

Other differences from existing shoe products are as follows: the upper 2 is fixedly equipped with a press type inflation and deflation valve 5, it can be existing products and directly purchased from the market, the air outlet of the inflation and deflation valve 5 connects to the air inlet/outlet of the airbag 4 through an inflation tube 6. In order to better protect the stable connection between the inflation and deflation valve 5, the inflation tube 6 and the airbag 4, so that the auxiliary training structure can function stably during training, in this embodiment as shown in FIG. 1, the inflation and deflation valve 5 is positioned on the outer surface of the upper 2 corresponding to the inner side of human foot where it is not easily to be hooked and damaged from outside. The upper 2 near the corresponding airbag 4 is provided with a through hole 21 for the inflation tube to pass through, it is close to the air inlet/outlet of the airbag 4 to reduce the risk of affecting the inlet and outlet air at the connection point. The upper 2 is fixedly equipped with a protection cover 22 enveloping the inflation tube 5, as shown in the figures, the protection cover 22 is a long strip of sheet material with both longitudinally sides connected to the upper 2, forming a channel for the inflation tube 5 to pass through, thus forming the required protection structure.

Furthermore, in this embodiment, it can be further setup, specifically by compounding a surface layer 314 on the upper surface of the insole 3, the surface layer 314 can have corresponding openings in the parts corresponding to the opening sections 312, or as shown in the figures, the surface layer 314 can have elastic sections 315 which are elastic and stretchable in the parts corresponding to the opening sections 312. The surface layer 314 can be made of knitted fabric. The elastic sections 315 not only do not affect deformation and opening of the opening sections 312 in the above-mentioned inflated state, but also can block the openings after deformation and opening. And the elastic sections 315 can also pull and act on the bugle curvature of the plastic D-shaped area 31 which is lifted, and approaching a comfortable and ideal bulge shape, as shown in FIG. 3.

Figure 4:
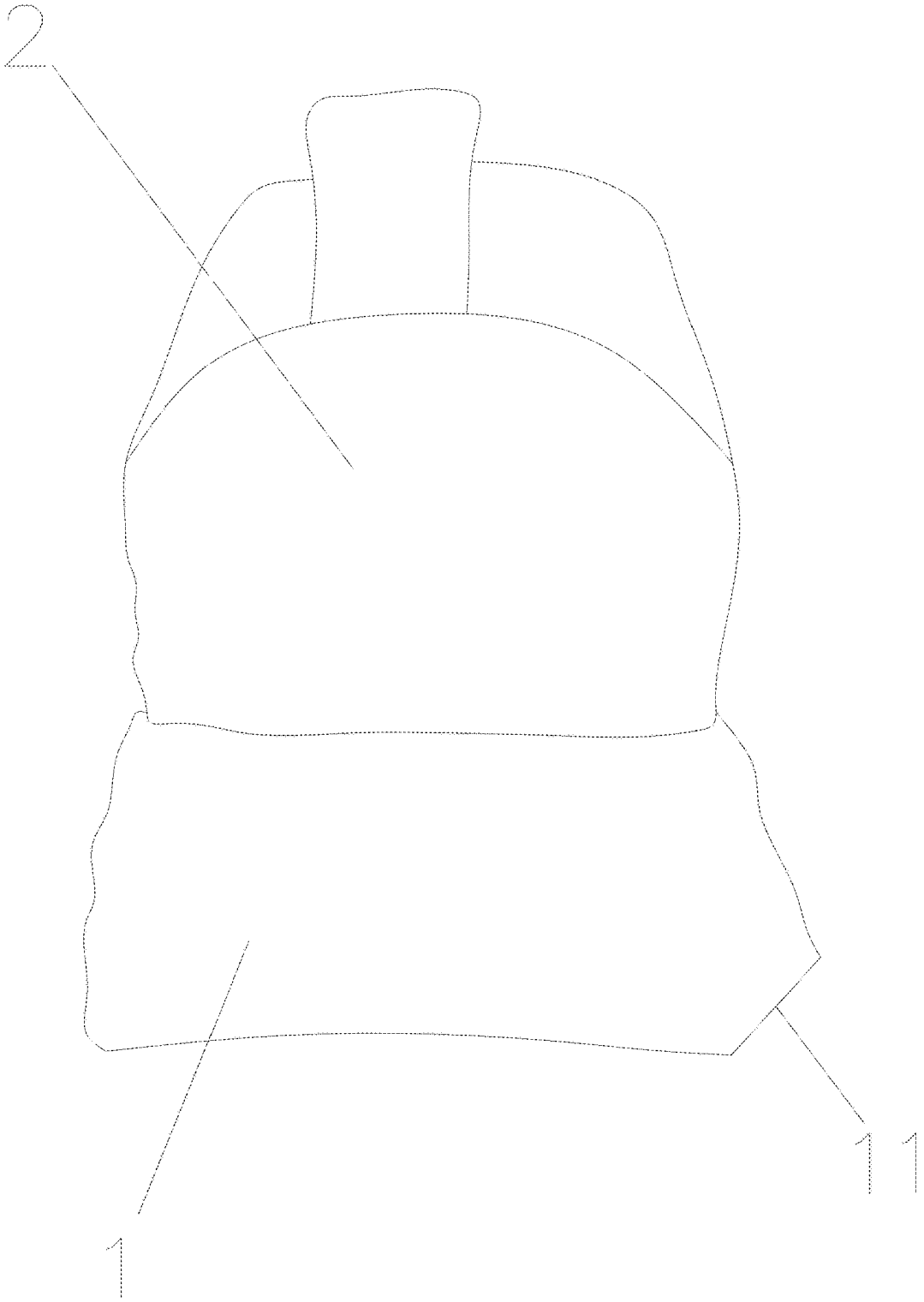
FIG. 4 is schematic diagram of the structure of the heel view of a sports shoe for flat foot prevention and correction related to the present utility model.

In professional flat foot prevention and correction training, during toe retraction (toe grip) training, the foot can be further rolled over, that means while performing the action of toe retraction (toe grip), the ankle rotates inward to lift the inner side of foot and the outside of foot exerts force on the ground. According to the requirements of this action, furthermore in this embodiment, as shown in FIG. 4, the sole 1 forms a beveled surface 11 at the boundary between its outer sidewall corresponding to the outside of human foot and the bottom surface of the sole, the beveled surface 11 can quickly guide the trainee to roll over to the required angle for the training and confirm the action is in place. The angle between the beveled surface 11 and the horizontal plane should be within 30-50 degree for optional guiding effect.

Due to the above structure, a sports shoe for flat foot prevention and correction of the present utility model can better assist in flat foot correction training, achieving training at any time and better flat foot prevention and correction results.

The above embodiments and drawings do not limit the product form and style of the present utility model. Any appropriate changes or modifications made by ordinary technical personnel in the technical field shall be deemed not to be outside the scope of the present utility model patent.

What is claimed is:

1. A sports shoe for flat foot prevention and correction, comprising a sole, an upper bonded to said sole and an insole embedded in said upper and placed on said sole, characterized in that the area of said insole corresponding to the arch of human foot is D-shaped area for auxiliary correction training, the vertical line part of D shape of said D-shaped area is the outline edge of the insole, while the arc part of D shape of said D-shaped area are divided into three sections, namely the middle section which is connected to the other parts of the insole as a whole and the two opening sections which are between the two ends of the middle section and the two ends of the vertical line part of D shape, and said opening sections are separated from the other parts of the insole to form openings, the bottom surface of said D-shaped area is fixedly bonded with an airbag, said upper is fixedly equipped with a press type inflation and deflation valve, the air outlet of said inflation and deflation valve connects to the air inlet/outlet of the airbag through an inflation tube, said the sole forms a beveled surface at the boundary between its outer sidewall corresponding to the outside of human foot and the bottom surface of the sole.

2. A sports shoe for flat foot prevention and correction as claimed in claim 1, characterized in that, a sinking groove is equipped on the bottom surface of said D-shaped area where one side of the airbag can be correspondingly embedded and fixedly bonded, said inflation and deflation valve is positioned on the outer surface of the upper corresponding to the inner side of human foot, said upper near the corresponding airbag is provided with a through hole for the inflation tube to pass through, said upper is fixedly equipped with a protection cover enveloping the inflation tube.

3. A sports shoe for flat foot prevention and correction as claimed in claim 1, characterized in that, the upper surface of said insole is setup with a surface layer by compounding, said surface layer can have corresponding openings in the parts corresponding to the opening sections, or said surface layer can have elastic sections which are elastic and stretchable in the parts corresponding to the opening sections.

4. A sports shoe for flat foot prevention and correction as claimed in claim 2, characterized in that, the upper surface of said insole is setup with a surface layer by compounding, said surface layer can have corresponding openings in the parts corresponding to the opening sections, or said surface layer can have elastic sections which are elastic and stretchable in the parts corresponding to the opening sections.

5. A sports shoe for flat foot prevention and correction as claimed in claim 1, characterized in that, the angle between said beveled surface and the horizontal plane is within 30-50 degree.

* * * * *